US010556778B2

(12) United States Patent
Yuzawa

(10) Patent No.: US 10,556,778 B2
(45) Date of Patent: Feb. 11, 2020

(54) WORK MACHINE WITH MULTIPLE SENSORS

(71) Applicant: SUMITOMO(S.H.I.) CONSTRUCTION MACHINERY CO., LTD., Tokyo (JP)

(72) Inventor: Yoshimitsu Yuzawa, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 16/143,989

(22) Filed: Sep. 27, 2018

(65) Prior Publication Data

US 2019/0023539 A1 Jan. 24, 2019

Related U.S. Application Data

(63) Continuation of application No. PCT/JP2017/012064, filed on Mar. 24, 2017.

(30) Foreign Application Priority Data

Mar. 30, 2016 (JP) ..... 2016-067883

(51) Int. Cl.
*E02F 9/24* (2006.01)
*B66C 15/04* (2006.01)
(Continued)

(52) U.S. Cl.
CPC ..... *B66C 15/04* (2013.01); *B66C 13/18* (2013.01); *B66C 23/36* (2013.01); *B66C 23/54* (2013.01);
(Continued)

(58) Field of Classification Search
CPC ..... E02F 3/845; E02F 9/264
See application file for complete search history.

(56) References Cited

U.S. PATENT DOCUMENTS 6,129,158 A * 10/2000 Yamamoto ..... E02F 3/845 172/812
2011/0004379 A1* 1/2011 Murota ..... E02F 3/43 701/50
2011/0264334 A1* 10/2011 Murota ..... E02F 9/226 701/50

FOREIGN PATENT DOCUMENTS

EP 2019170 1/2009
JP 60208524 A * 10/1985 ..... E02F 3/435
JP 01178621 A * 7/1989 ..... E02F 3/433
JP H03-221628 9/1991
JP 2793950 9/1998
JP 2004132077 A * 4/2004 ..... E02F 9/166
JP 2006161465 A * 6/2006 ..... E02F 9/2033
(Continued)

OTHER PUBLICATIONS

International Search Report for PCT/JP2017/012064 dated Jun. 20, 2017.

*Primary Examiner* — Gerald McClain
(74) *Attorney, Agent, or Firm* — IPUSA, PLLC

(57) ABSTRACT

A work machine includes a traveling undercarriage, an upper rotating structure swingably mounted on the traveling undercarriage, a cab mounted on the upper rotating structure, an attachment including multiple work elements and attached to the upper rotating structure, an end attachment attached to the end of the attachment, a first sensor configured to obtain the angles of rotation of the work elements, a second sensor configured to obtain the angle of rotation of the end attachment, and a control device configured to restrict or stop the motion of reducing a distance between the end attachment and the cab in response to determining that the end attachment has entered a predetermined region based on the outputs of the first sensor and the second sensor.

9 Claims, 6 Drawing Sheets

(51) Int. Cl.

| | |
|---|---|
| ***E02F 3/43*** | (2006.01) |
| ***B66C 13/18*** | (2006.01) |
| ***B66C 23/36*** | (2006.01) |
| ***B66C 23/00*** | (2006.01) |
| ***B66C 23/90*** | (2006.01) |
| ***E02F 3/96*** | (2006.01) |
| *B66C 1/04* | (2006.01) |
| *B66C 13/54* | (2006.01) |
| *E02F 9/20* | (2006.01) |
| *E02F 9/22* | (2006.01) |

(52) U.S. Cl.

CPC ..... *B66C 23/90* (2013.01); *E02F 3/43* (2013.01); *E02F 3/963* (2013.01); *E02F 9/24* (2013.01); *B66C 1/04* (2013.01); *B66C 13/54* (2013.01); *E02F 3/435* (2013.01); *E02F 9/2033* (2013.01); *E02F 9/2271* (2013.01)

(56) References Cited

FOREIGN PATENT DOCUMENTS

| | | | | | |
|---|---|---|---|---|---|
| JP | 2007107311 | A | * | 4/2007 | |
| JP | 2009197438 | A | * | 9/2009 | ..... E02F 3/43 |
| JP | 2010-265620 | | | 11/2010 | |
| JP | 2010265620 | A | * | 11/2010 | |
| JP | 2010-270523 | | | 12/2010 | |
| JP | 2010270523 | A | * | 12/2010 | |
| JP | 2013-076286 | | | 4/2013 | |
| JP | 2014-001596 | | | 1/2014 | |
| JP | 2014001596 | A | * | 1/2014 | |
| JP | 2014-163156 | | | 9/2014 | |
| JP | 2014163156 | A | * | 9/2014 | |
| JP | 2016-030954 | | | 3/2016 | |
| JP | 2016030954 | A | * | 3/2016 | |

* cited by examiner

WORK MACHINE WITH MULTIPLE SENSORS

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2017/012064, filed on Mar. 24, 2017 and designating the U.S., which claims priority to Japanese patent application No. 2016-067883, filed on Mar. 30, 2016. The entire contents of the foregoing applications are incorporated herein by reference.

BACKGROUND

Technical Field

The present invention relates to work machines including an end attachment and a cab.

Description of Related Art

A construction machine with an interference preventing device to prevent the interference of a bucket and a cab is known. This interference preventing device detects the angles of a boom, an arm, etc., to calculate the position of the end of the arm, and stops the movement of the attachment when the end of the arm enters a predetermined stop area set around the cab.

SUMMARY

According to an aspect of the present invention, a work machine includes a traveling undercarriage, an upper rotating structure swingably mounted on the traveling undercarriage, a cab mounted on the upper rotating structure, an attachment including multiple work elements and attached to the upper rotating structure, an end attachment attached to the end of the attachment, a first sensor configured to obtain the angles of rotation of the work elements, a second sensor configured to obtain the angle of rotation of the end attachment, and a control device configured to restrict or stop the motion of reducing a distance between the end attachment and the cab in response to determining that the end attachment has entered a predetermined region based on the outputs of the first sensor and the second sensor.

DETAILED DESCRIPTION

The related-art interference preventing device as described above, however, does not detect the angle of the bucket. Therefore, the stop area is set to prevent the interference of the bucket and the cab no matter how the angle of the bucket changes. As a result, the range of movement of the attachment is excessively restricted.

In view of the above-described point, it is desired to provide a work machine that more appropriately restricts the range of movement of an attachment.

According to an aspect of the present invention, it is possible to provide a work machine that more appropriately restricts the range of movement of an attachment.

Figure 1:
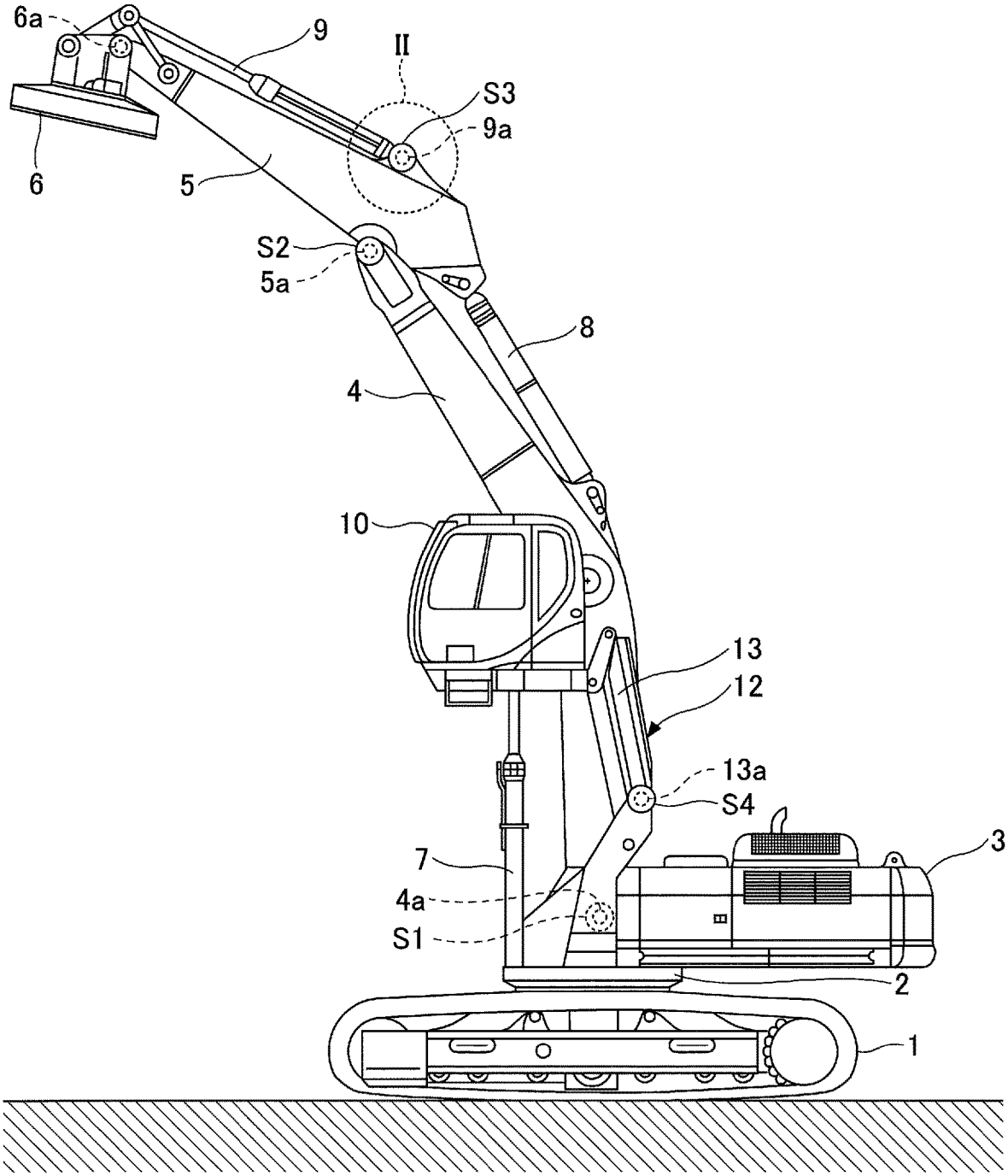
FIG. 1 is a schematic side view of a work machine.

An embodiment of the present invention is described below with reference to the drawings. FIG. 1 is a schematic side view of a work machine according the embodiment of the present invention.

The work machine includes a traveling undercarriage 1, a swing mechanism 2, an upper rotating structure 3, a boom 4, an arm 5, a lifting magnet 6 (hereinafter referred to as "lift-mag 6"), a boom cylinder 7, an arm cylinder 8, an end attachment cylinder 9, a cab 10, a boom angle sensor S1, an arm angle sensor S2, an end attachment angle sensor S3, and a cab height sensor S4. The boom 4 and the arm 5 form an attachment.

The upper rotating structure 3 is swingably mounted on the traveling undercarriage 1 of the work machine via the swing mechanism 2. The boom 4 serving as a work element is pivotably coupled to the front center of the upper rotating structure 3. The arm 5 serving as a work element is pivotably coupled to the end of the boom 4. The lift-mag 6 serving as an end attachment is pivotably coupled to the end of the arm 5. The end attachment may alternatively be a bucket, a grapple, or a dismantling fork.

The cab 10 serving as an operator's compartment is so provided on the upper rotating structure 3 via a cab elevator 12 as to be able to move up and down. Such a cab that can move up and down is referred to as "elevator cab." FIG. 1 illustrates the cab 10 moved up to the highest position by the cab elevator 12. The cab 10 is positioned beside (normally, on the left side of) the boom 4.

The boom angle sensor S1 is a sensor to obtain a boom angle. The boom angle is, for example, the angle of rotation of the boom 4 about a boom foot pin 4*a*. For example, the boom angle is zero degrees when the boom 4 is most lowered. In the illustration of FIG. 1, the boom angle sensor S1 is attached near the boom foot pin 4*a*. The boom angle may alternatively be calculated based on the output of a stroke sensor to detect the amount of stroke of the boom cylinder 7 or a tilt (acceleration) sensor to detect the tilt angle of the boom 4 relative to a horizontal plane.

The arm angle sensor S2 is a sensor to obtain an arm angle. The arm angle is, for example, the angle of rotation of the arm 5 about an arm foot pin 5*a*. For example, the arm angle is zero degrees when the arm 5 is most closed. In the illustration of FIG. 1, like the boom angle sensor S1, the arm angle sensor S2 is attached near the arm foot pin 5*a*. The arm angle may alternatively be calculated based on the output of a stroke sensor to detect the amount of stroke of the arm cylinder 8 or a tilt (acceleration) sensor to detect the tilt angle of the arm 5 relative to a horizontal plane.

The end attachment angle sensor S3 is a sensor to obtain an end attachment angle. The end attachment angle is, for example, the angle of rotation of the lift-mag 6 about an end attachment foot pin 6*a*. For example, the end attachment angle is zero degrees when the lift-mag 6 is most closed. In the illustration of FIG. 1, unlike the boom angle sensor S1 and the arm angle sensor S2, the end attachment angle sensor S3 is attached not near the end attachment foot pin 6*a* but near a foot pin 9*a* of the end attachment cylinder 9. This is because when attached near the end attachment foot pin 6*a*, the end attachment angle sensor S3 has more chance of contacting a work object such as scrap material to be more likely to be damaged. The end attachment angle may alternatively be calculated based on the output of a stroke sensor to detect the amount of stroke of the end attachment cylinder 9 or a tilt (acceleration) sensor to detect the tilt angle of the lift-mag 6 relative to a horizontal plane.

The cab height sensor S4 is a sensor to obtain the height of the cab 10. The height of the cab 10 is, for example, a height from the base frame of the upper rotating structure. For example, the height of the cab 10 is a zero height when the cab 10 that can move up and down is in contact with the base frame (when the cab 10 is most lowered). In the illustration of FIG. 1, the cab height sensor S4 is an angle sensor to detect the angle of rotation of a link 13 of a parallel linkage in the cab elevator 12 about a link foot pin 13*a*, and is attached near the link foot pin 13*a* of the link 13. For example, the angle of rotation of the link 13 is zero degrees when the cab 10 is most lowered. The cab height sensor S4 determines the height of the cab 10 from the angle of rotation of the link 13. The cab height sensor S4 may output the angle of rotation of the link 13 to a controller 30. In this case, the controller 30 calculates the height of the cab 10 based on the angle of rotation of the link 13. The height of the cab 10 may alternatively be calculated based on the output of a stroke sensor to detect the amount of stroke of a cab elevation cylinder or a tilt (acceleration) sensor to detect the tilt angle of the link 13 relative to a horizontal plane.

At least one of the boom angle sensor S1, the arm angle sensor S2, the end attachment angle sensor S3, and the cab height sensor S4 may be configured with a combination of an acceleration sensor and a gyro sensor.

Figure 2A:
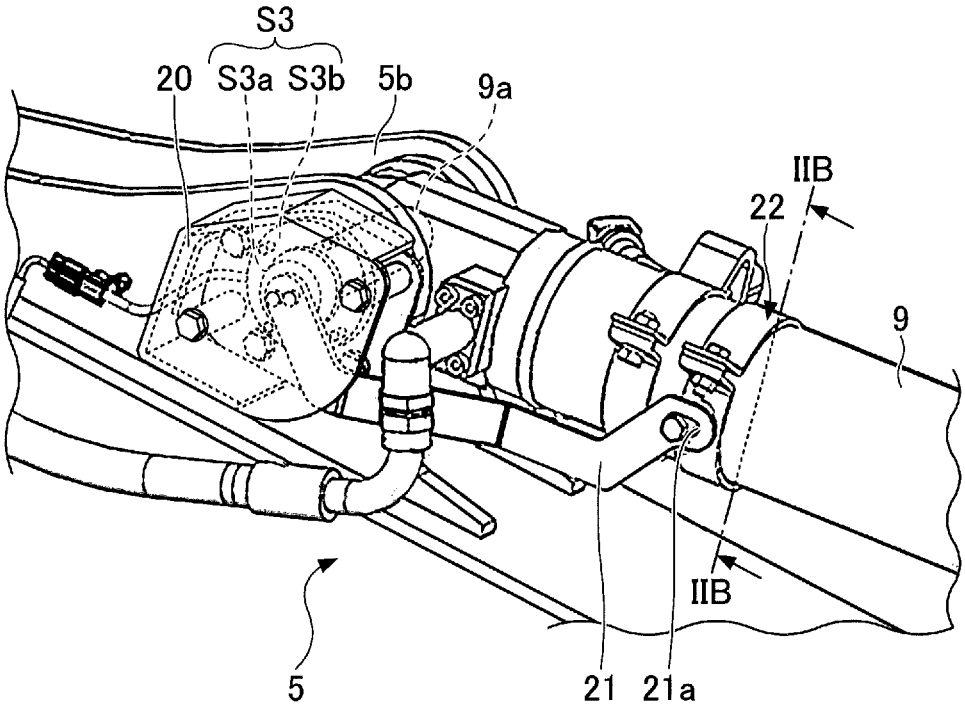
FIG. 2A is a diagram illustrating a configuration of an end attachment angle sensor.
Figure 2B:
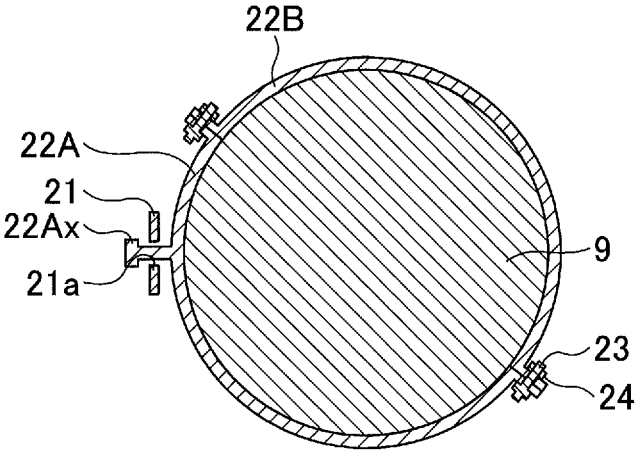
FIG. 2B is a diagram illustrating a configuration of an end attachment angle sensor.

Next, a configuration of the end attachment angle sensor S3 is described with reference to FIGS. 2A and 2B. FIG. 2A is an enlarged perspective view of a region indicated by the dashed circle II of FIG. 1 from the opposite side. FIG. 2B is a cross-sectional view of the end attachment cylinder 9, looking at a plane including the line segment IIB-IIB of FIG. 2A in the direction indicated by the arrows.

The end attachment angle sensor S3 is accommodated in a cover case 20 attached to a bracket 5*b* of the arm 5. The bracket 5*b* is a pair of metal plates to which the foot pin 9*a* of the end attachment cylinder 9 is fixed.

The end attachment angle sensor S3 includes a pivotable part S3*a* and a fixed part S3*b*. The pivotable part S3*a* has a rotation shaft coaxial with the shaft of the foot pin 9*a*. The fixed part S3*b* is fixed to the bracket 5*b* together with the cover case 20, and supports the pivotable part S3*a* such that the pivotable part S3*a* is pivotable. A sensor arm 21 is attached to the pivotable part S3*a*.

The sensor arm 21 has one end (proximal end) fixed to the pivotable part S3*a* of the end attachment angle sensor S3 and the other end (distal end) pivotably attached to a band 22.

The band 22 is a member for attaching the distal end of the sensor arm 21 to the periphery of the end attachment cylinder 9. In the illustration of FIGS. 2A and 2B, the band 22 includes a first semiannular part 22A and a second semiannular part 22B. The first semiannular part 22A and the second semiannular part 22B are fastened with bolts 23 and nuts 24 at their respective ends to form an annular band having an inside diameter substantially equal to the outside diameter of the end attachment cylinder 9. The first semiannular part 22A has a protrusion 22Ax protruding outward from its peripheral surface. The protrusion 22Ax is, for example, a rod-shaped member welded to the first semiannular part 22A, and extends through a hole 21*a* formed in the sensor arm 21 at its distal end.

When the end attachment cylinder 9 is extended or contracted to pivot the lift-mag 6 about the end attachment foot pin 6*a*, the end attachment cylinder 9 pivots about the foot pin 9*a*. The sensor arm 21 pivots about the foot pin 9*a* together with the end attachment cylinder 9. The pivotable part S3*a* of the end attachment angle sensor S3 pivots about the foot pin 9*a* together with the sensor arm 21.

The end attachment angle sensor S3 detects the angle of rotation of the pivotable part S3*a* relative to the fixed part S3*b* as an end attachment cylinder angle, and determines the end attachment angle from the end attachment cylinder angle. The end attachment angle sensor S3 may output the end attachment cylinder angle to the controller 30. In this case, the controller 30 calculates the end attachment angle based on the end attachment cylinder angle.

According to the above-described configuration, the end attachment angle sensor S3 can obtain the end attachment angle the same as in the case of being attached near the end attachment foot pin 6*a*, and then produces the effect that the end attachment angle sensor S3 is less likely to be damaged than in the case of being attached near the end attachment foot pin 6*a*.

The distal end of the sensor arm 21 is attached to the end attachment cylinder 9 using the band 22. Therefore, no special processing such as welding the protrusion 22Ax to the end attachment cylinder 9 is necessary. Accordingly, the end attachment angle sensor S3 is easily attachable to standard cylinders.

Figure 3:
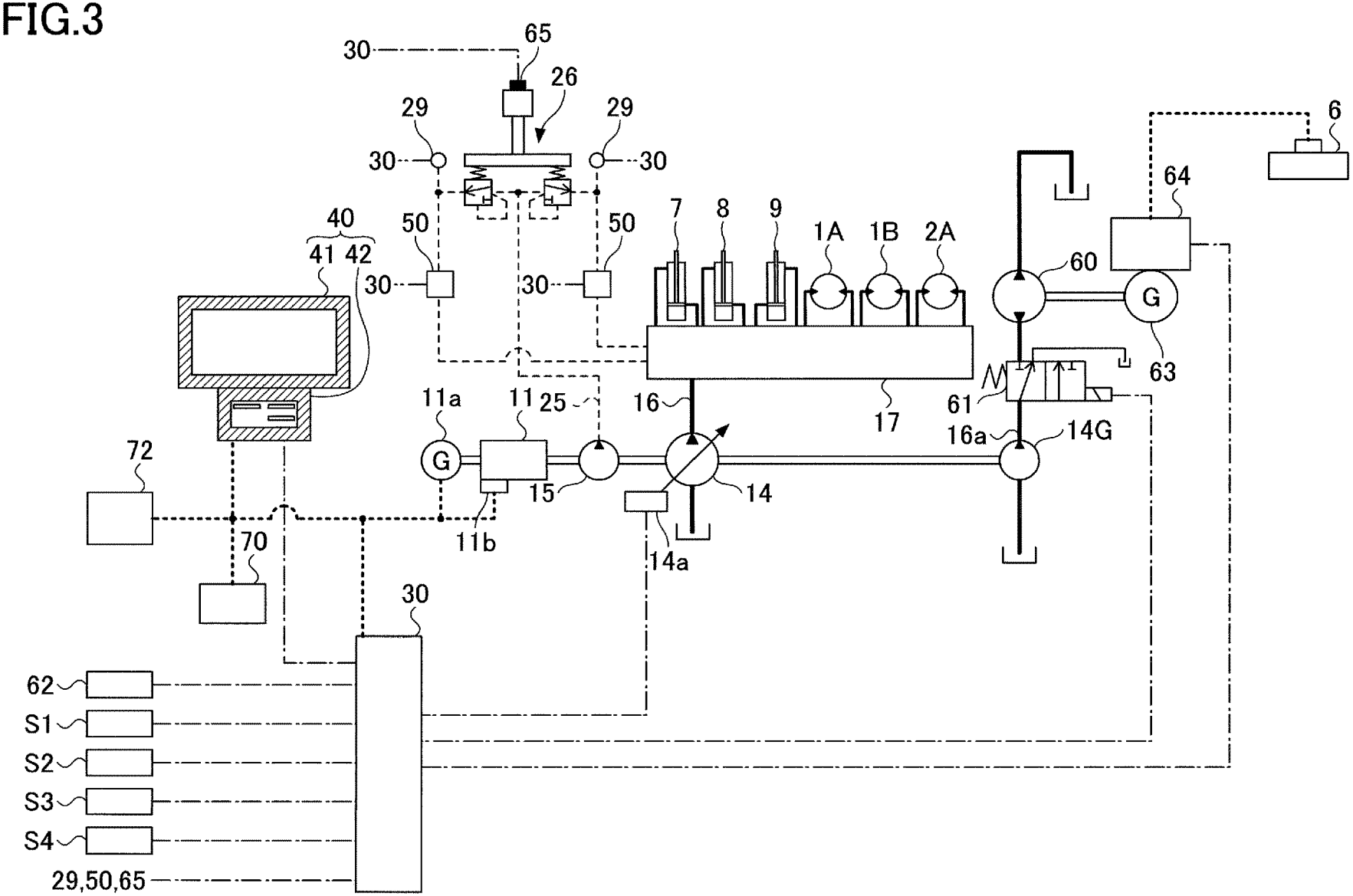
FIG. 3 is a block diagram illustrating a configuration of a drive system of the work machine.

Next, a configuration of the drive system of the work machine illustrated in FIG. 1 is described with reference to FIG. 3. FIG. 3 is a block diagram illustrating a configuration of the drive system of the work machine illustrated in FIG. 1. In FIG. 3, a mechanical power transmission line, a hydraulic oil line, a pilot line, an electric control line, and an electric drive line are indicated by a double line, a thick solid line, a dashed line, a one-dot chain line, and a thick dotted line, respectively.

The drive system of the work machine of FIG. 1 is composed mainly of an engine 11, an alternator 11*a*, a main pump 14, a lift-mag hydraulic pump 14G, a pilot pump 15, a control valve 17, an operating apparatus 26, and the controller 30.

The engine 11 is the drive source of the work machine, and is, for example, a diesel engine that operates to maintain a predetermined rotation speed. The output shaft of the engine 11 is connected to each of the input shafts of the alternator 11*a*, the main pump 14, the lift-mag hydraulic pump 14G, and the pilot pump 15.

The main pump 14 is a hydraulic pump that supplies hydraulic oil to the control valve 17 through a hydraulic oil line 16, and is a swash-plate variable displacement hydraulic pump, for example.

A regulator 14*a* is a device that regulates the discharge quantity of the main pump 14. According to this embodiment, the regulator 14*a* regulates the discharge quantity of the main pump 14 by controlling the swash plate tilt angle of the main pump 14 in accordance with the discharge pressure of the main pump 14, a control signal from the controller 30, etc.

The pilot pump 15 is a hydraulic pump for supplying hydraulic oil to various hydraulic control apparatuses including the operating apparatus 26 via a pilot line 25, and is a fixed displacement hydraulic pump, for example.

The control valve 17 is a hydraulic controller that controls the hydraulic system of the work machine. The control valve 17 selectively supplies hydraulic oil discharged by the main pump 14 to one or more of, for example, the boom cylinder 7, the arm cylinder 8, the end attachment cylinder 9, a right-side traveling hydraulic motor 1A, a left-side traveling hydraulic motor 1B, and a swing hydraulic motor 2A. In the following, the boom cylinder 7, the arm cylinder 8, the end attachment cylinder 9, the right-side traveling hydraulic motor 1A, the left-side traveling hydraulic motor 1B, and the swing hydraulic motor 2A may be collectively referred to as "hydraulic actuators."

The operating apparatus 26 is an apparatus that an operator uses to operate the hydraulic actuators. According to this embodiment, the operating apparatus 26 generates a pilot pressure by supplying hydraulic oil from the pilot pump 15 to the pilot port of a corresponding flow control valve in the control valve 17. Specifically, the operating apparatus 26 includes a swing operation lever, a boom operation lever, an arm operation lever, a lift-mag operation lever (an end attachment operation lever), and traveling pedals (none of which is depicted). The pilot pressure changes in accordance with the contents of operation of the operating apparatus 26. The contents of operation include, for example, the direction of operation and the amount of operation.

Pressure sensors 29 detect pilot pressures generated by the operating apparatus 26. According to this embodiment, the pressure sensors 29 detect pilot pressures generated by the operating apparatus 26, and output their detection values to the controller 30. The controller 30 understands the contents of each operation of the operating apparatus 26 based on the outputs of the pressure sensors 29.

The controller 30 is a control device for controlling the work machine, and is composed of a computer including a CPU, a RAM, a ROM, etc., for example. The controller 30 reads programs corresponding to operations or functions of the work machine from the ROM, loads the programs into the RAM, and causes the CPU to execute processes corresponding to the programs.

The lift-mag hydraulic pump 14G supplies hydraulic oil to a lift-mag hydraulic motor 60 via a hydraulic oil line 16*a*. According to this embodiment, the lift-mag hydraulic pump 14G is a fixed displacement hydraulic pump, and supplies hydraulic oil to the lift-mag hydraulic motor 60 through a selector valve 61.

The selector valve 61 switches the direction of hydraulic oil discharged by the lift-mag hydraulic pump 14G. According to this embodiment, the selector valve 61 is a solenoid valve that switches in accordance with a control command from the controller 30, and has a first position to connect the lift-mag hydraulic pump 14G and the lift-mag hydraulic motor 60 and a second position to disconnect the lift-mag hydraulic pump 14G and the lift-mag hydraulic motor 60.

When a mode change switch 62 is operated to switch the operating mode of the work machine to a lift-mag mode, the controller 30 outputs a control signal to the selector valve 61 to switch the selector valve 61 to the first position. When the mode change switch 62 is operated to switch the operating mode of the work machine to other than the lift-mag mode, the controller 30 outputs a control signal to the selector valve 61 to switch the selector valve 61 to the second position. FIG. 3 illustrates the selector valve 61 in the second position.

The mode change switch 62 is a switch for changing the operating mode of the work machine, and is a rocker switch installed in the cab 10 according to this embodiment. The operator operates the mode change switch 62 to perform two-alternative switching between a shovel mode and the lift-mag mode. The shovel mode is a mode for causing the work machine to operate as a shovel, and is selected when, for example, a bucket is attached instead of the lift-mag 6. The lift-mag mode is a mode for causing the work machine to operate as a work machine with a lift-mag, and is selected when the lift-mag 6 is attached to the end of the arm 5. The controller 30 may automatically change the operating mode of the work machine based on the outputs of various sensors.

In the case of the lift-mag mode, the selector valve 61 is set in the first position to cause hydraulic oil discharged by the lift-mag hydraulic pump 14G to flow into the lift-mag hydraulic motor 60. In the case of other than the lift-mag mode, the selector valve 61 is set in the second position to cause hydraulic oil discharged by the lift-mag hydraulic pump 14G to flow to a hydraulic oil tank instead of flowing into the lift-mag hydraulic motor 60.

The rotating shaft of the lift-mag hydraulic motor 60 is mechanically coupled to the rotating shaft of a lift-mag generator 63. The lift-mag generator 63 is a generator that generates electric power for exciting the lift-mag 6. According to this embodiment, the lift-mag generator 63 is an alternating-current generator that operates in accordance with a control signal from an electric power control device 64.

The electric power control device 64 is a device that controls supplying and interrupting electric power for exciting the lift-mag 6. According to this embodiment, the electric power control device 64 controls starting and stopping generation of alternating-current electric power by the lift-mag generator 63 in accordance with a generation start command and a generation stop command from the controller 30. The electric power control device 64 converts the alternating-current electric power generated by the lift-mag generator 63 into direct-current electric power, and supplies the direct-current electric power to the lift-mag 6. The electric power control device 64 can control the magnitude of direct-current voltage applied to the lift-mag 6.

When a lift-mag switch 65 is operated to turn on, the controller 30 outputs an attraction command to the electric power control device 64. In response to receiving the attraction command, the electric power control device 64 converts the alternating-current electric power generated by the lift-mag generator 63 into direct-current electric power, and supplies the direct-current electric power to the lift-mag 6 to excite the lift-mag 6. The excited lift-mag 6 is in an attracting condition to be able to attract an object.

When the lift-mag switch 65 is operated to turn off, the controller 30 outputs a release command to the electric power control device 64. In response to receiving the release command, the electric power control device 64 stops generation of electric power by the lift-mag generator 63 to turn the lift-mag 6 in the attracting condition into a non-attracting (releasing) condition. The lift-mag switch 65 is a switch to switch attraction and release by the lift-mag 6. According to this embodiment, the lift-mag switch 65 is a push-button switch provided on the top of at least one of paired left and right operating levers for operating the swing mechanism 2, the boom 4, the arm 5, and the lift-mag 6. The lift-mag switch 65 may be configured to alternately turn on and off every time the button is depressed, or may be configured to have a turn-on button and a turn-off button separately provided.

According to this configuration, the work machine can perform work such as attracting and carrying an object using the lift-mag 6 while operating hydraulic actuators with hydraulic oil discharged by the main pump 14.

An image display device 40 is a device that displays various kinds of information. According to this embodiment, the image display device 40 is fixed to a pillar (not depicted) of the cab 10 in which an operator's seat is provided. The image display device 40 can provide the operator with information by displaying the operating situation of the work machine, control information, etc., on an image display part 41. The image display device 40 includes a switch panel 42 serving as an input part. The operator can input information and commands to the controller 30 of the work machine using the switch panel 42.

The image display device 40 operates by receiving a supply of electric power from a rechargeable battery 70. The rechargeable battery 70 is charged with electric power generated in the alternator 11*a*. The electric power of the rechargeable battery 70 is also supplied to electrical equipment 72 of the work machine, aside from the controller 30 and the image display device 40. A starter 11*b* of the engine 11 is driven with electric power from the rechargeable battery 70 to start the engine 11.

Control valves 50 control the communication and interruption of pilot lines between the operating apparatus 26 and flow control valves in the control valve 17. In the illustration of FIG. 3, the control valves 50 are solenoid proportional valves that operate in accordance with a command from the controller 30.

Figure 4A:
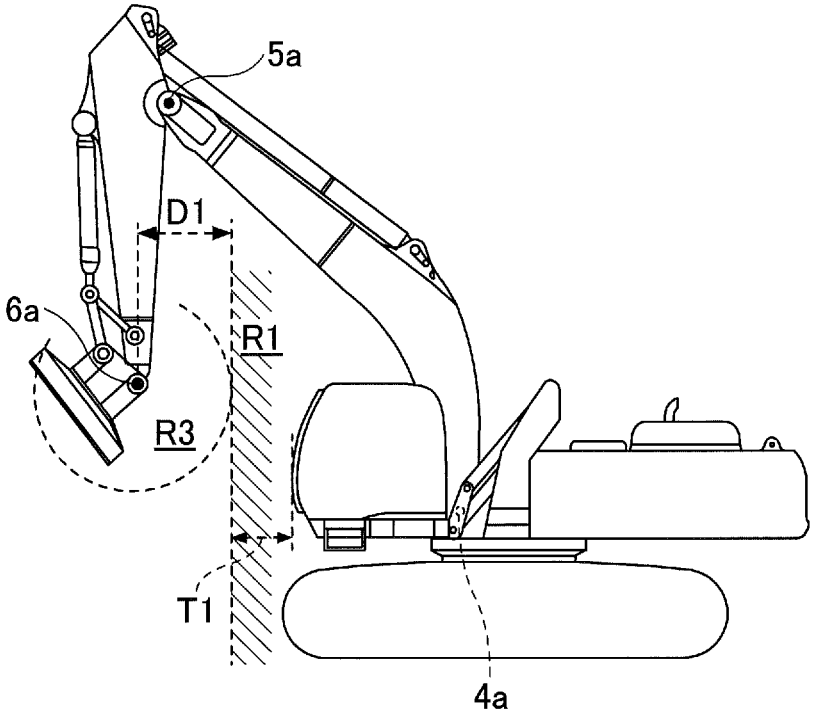
FIG. 4A is a diagram illustrating an interference preventing function.
Figure 4B:
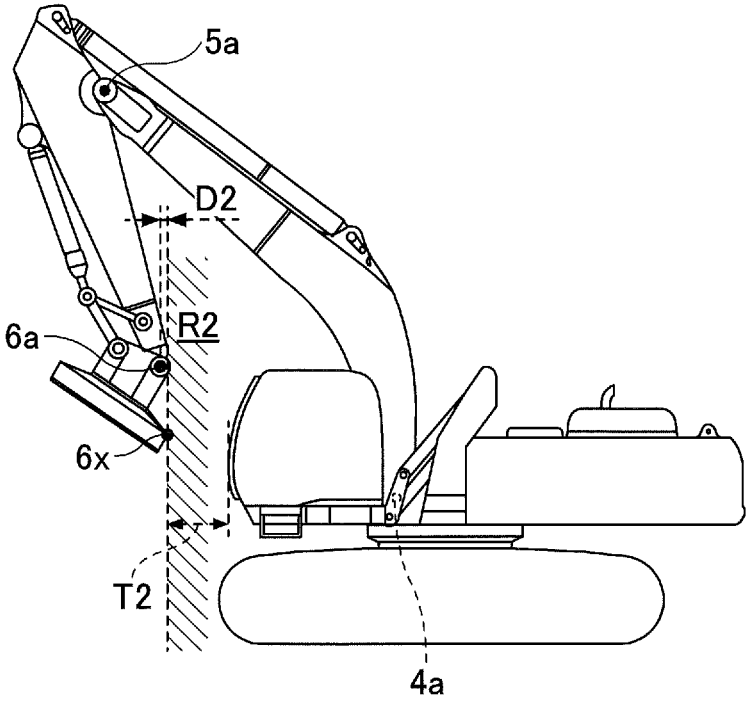
FIG. 4B is a diagram illustrating the interference preventing function.

Next, an interference preventing function is described with reference to FIGS. 4A and 4B. FIGS. 4A and 4B are side views of the work machine of FIG. 1. FIG. 4A illustrates an effect of the interference preventing function in the case of not using the end attachment angle. FIG. 4B illustrates an effect of the interference preventing function in the case of using the end attachment angle.

The interference preventing function is executed using, for example, a coordinate system using a reference point on the work machine as its origin. The reference point is, for example, a point on the swing axis of the work machine. The coordinate system is, for example, a three-dimensional Cartesian coordinate system. The reference point may be another point such as the position of the boom foot pin 4*a*. The coordinate system may be other coordinate systems such as a three-dimensional polar coordinate system, a two-dimensional Cartesian coordinate system, and a two-dimensional polar coordinate system.

Using the above-described coordinate system and the known dimensions of members, the controller 30 can determine the coordinates of the arm foot pin 5*a* based on the output of the boom angle sensor S1. Furthermore, the controller 30 can determine the coordinates of the end attachment foot pin 6*a* based on the outputs of the boom angle sensor S1 and the arm angle sensor S2. Moreover, the controller 30 can determine the coordinates of a nearest point 6*x* of the lift-mag 6 based on the outputs of the boom angle sensor S1, the arm angle sensor S2, and the end attachment angle sensor S3.

The nearest point 6*x* of the lift-mag 6 is the coordinate point nearest to the cab 10 among the coordinate points on the contour of the lift-mag 6, and is also referred to as the cab-side end of the end attachment. The position of the nearest point 6*x* on the lift-mag 6 changes depending on the posture of the lift-mag 6.

The controller 30 can determine the coordinates of the center point of the cab 10 based on the output of the cab height sensor S4.

The oblique line regions of FIGS. 4A and 4B indicate interference prevention regions R1 and R2 set around the cab 10. The interference prevention regions R1 and R2 are regions determined according to the coordinates of the center point of the cab 10, and rise as the cab 10 rises and lower as the cab 10 lowers. Accordingly, the controller 30 can determine coordinates that define the boundaries of the interference prevention regions R1 and R2 using the coordinates of the center point of the cab 10 determined based on the output of the cab height sensor S4. A distance T1 from the body (the cab 10) of the work machine to the boundary of the interference prevention region R1 in the case of FIG. 4A is equal to a distance T2 from the body (the cab 10) of the work machine to the boundary of the interference prevention region R2 in the case of FIG. 4B regardless of the height of the cab 10. The controller 30 determines whether it is necessary to restrict or stop the motion of the work machine to prevent the interference of the lift-mag 6 and the cab 10 based on the coordinates of the above-described points.

In the case of FIG. 4A where the end attachment angle is not used, the controller 30 determines a range of movement R3 of the lift-mag 6 based on the coordinates of the end attachment foot pin 6*a*. The dashed-line partial circle of FIG. 4A indicates the outline of the range of movement R3 of the lift-mag 6.

In response to determining that the interference prevention region R1 the range of movement R3 of the lift-mag 6 overlap each other, the controller 30 restricts or stops a motion of the work machine in a direction to increase the overlap region, namely, a motion of the work machine to further reduce a distance between the lift-mag 6 and the cab 10. The controller 30, however, does not restrict a motion of the work machine in a direction to reduce or eliminate the overlap region, that is, the motion of increasing a distance between the lift-mag 6 and the cab 10, in order to prevent a motion for avoiding the interference of the lift-mag 6 and the cab 10 from being restricted.

In the illustration of FIG. 4A, the controller 30 restricts or stops the motion of raising the boom 4, the motion of closing the arm 5, the motion of closing the lift-mag 6, and the motion of raising the cab 10 when the distance between the end attachment foot pin 6*a* and the interference prevention region R1 becomes a distance D1. Specifically, in the case of restricting or stopping the motion of raising the boom 4, the controller 30 outputs a command to the control valve 50 installed in a pilot line related to a boom raising operation to restrict or interrupt the communication of the pilot line. The pilot line related to the boom raising operation is a pilot line on the raising operation side between a flow control valve related to the boom cylinder 7 and the boom operation lever serving as the operating apparatus 26. The same is the case with the case of restricting or stopping the motion of closing the arm 5, the motion of closing the lift-mag 6, and the motion of raising the cab 10.

On the other hand, the controller 30 does not restrict the motion of lowering the boom 4, the motion of opening the arm 5, the motion of opening the lift-mag 6, and the motion of lowering the cab 10.

In the illustration of FIG. 4B, the controller 30 restricts or stops the motion of raising the boom 4, the motion of closing the arm 5, the motion of closing the lift-mag 6, and the motion of raising the cab 10 in response to determining that the nearest point 6*x* of the lift-mag 6 has entered the interference prevention region R2. At this point, the distance between the end attachment foot pin 6*a* and the interference prevention region R2 is a distance D2 (<D1), The distance D2 changes according to the end attachment angle. That is, the distance between the end attachment foot pin 6*a* and the body of the work machine at the time of restricting or stopping the motion of reducing a distance between the end attachment and the cab 10 changes according to the angle of rotation of the end attachment. This means that the range of movement of the end attachment is restricted based on the position of the cab-side end of the end attachment (the nearest point 6*x* of the lift-mag 6). On the other hand, the controller 30 does not restrict the motion of lowering the boom 4, the motion of opening the arm 5, the motion of opening the lift-mag 6, and the motion of lowering the cab 10.

Thus, in the case of executing the interference preventing function using the end attachment angle, the controller 30 can bring the lift-mag 6 closer to the cab 10 than in the case of executing the interference preventing function without using the end attachment angle. This is because in the case of not using the end attachment angle, it is necessary to restrict the motion of the work machine at a place relatively remote from the interference prevention region R1 so that the lift-mag 6 and the cab 10 do not interference with each other no matter how the posture of the lift-mag 6 changes. In contrast, in the case of using the end attachment angle, the motion of the work machine may be restricted so that the lift-mag 6 in a particular posture and the cab 10 do not interference with each other. This means that the range of movement of the attachment is more appropriately restricted, that is, that the range of movement of the attachment can be increased.

When the motion of the work machine is restricted or stopped to prevent the interference of the lift-mag 6 and the cab 10, the controller 30 may indicate that on the image display device 40 in order to inform the operator of the reason why the motion of the work machine is restricted or stopped. The controller 30 may so inform the operator by warning light or an alarm sound.

According to the above-described configuration, the controller 30 can change the degree of proximity of the lift-mag 6 to the cab 10 in accordance with the posture of the lift-mag 6 by executing the interference preventing function using the end attachment angle. Specifically, the controller 30 can bring the lift-mag 6 closer to the cab 10 as the lift-mag 6 is opened wider.

Figure 5A:
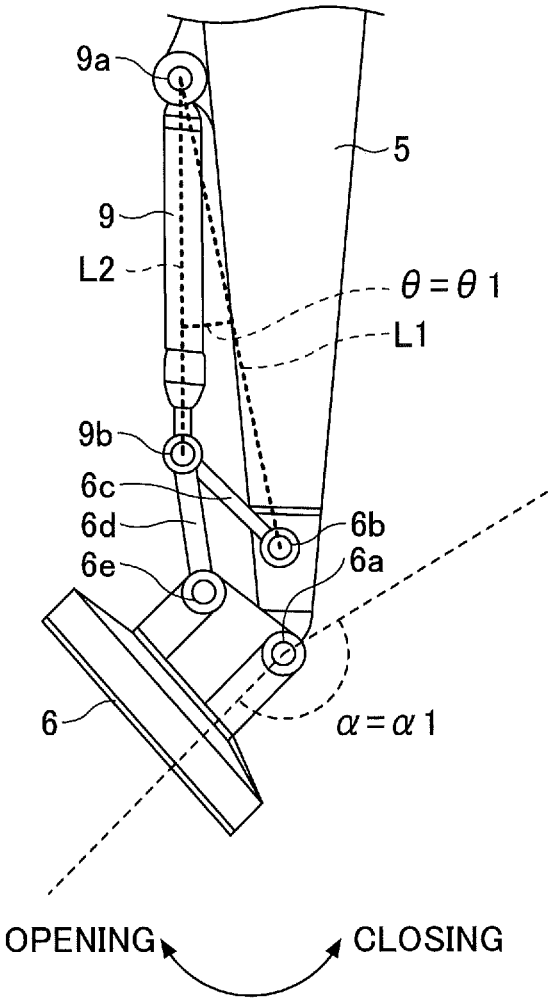
FIG. 5A is a diagram illustrating a method of deriving an end attachment angle from an end attachment cylinder angle.
Figure 5B:
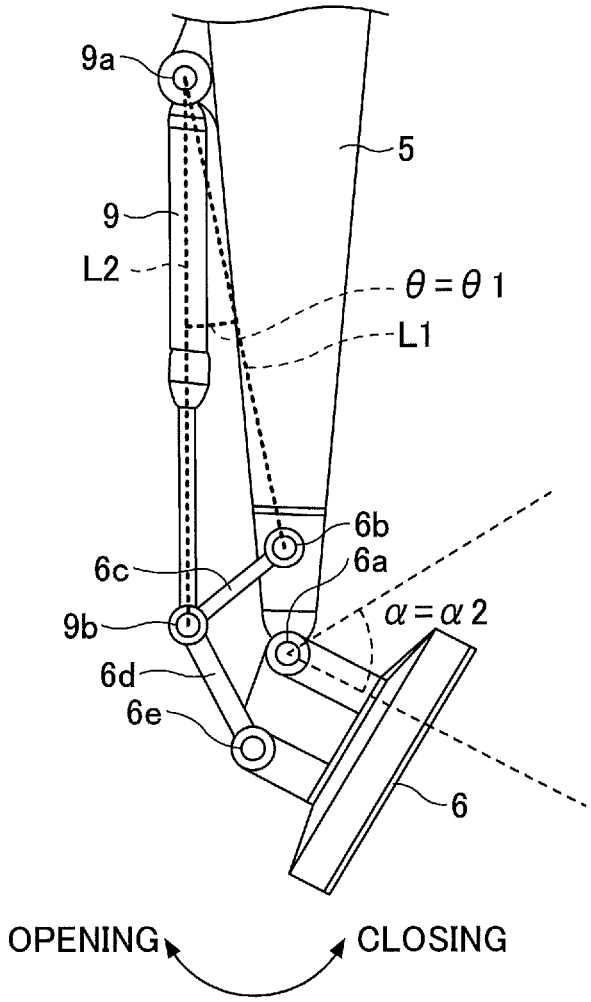
FIG. 5B is a diagram illustrating the method of deriving an end attachment angle from an end attachment cylinder angle.

Next, a method of deriving an end attachment angle $\alpha$ from an end attachment cylinder angle $\theta$ is described with reference to FIGS. 5A and 5B. FIG. 5A is a side view of an end portion of the attachment where the end attachment angle $\alpha$ is $\alpha 1$. FIG. 5B is a side view of the end portion of the attachment where the end attachment angle $\alpha$ is $\alpha 2$ ($<\alpha 1$). FIGS. 5A and 5B both illustrate that the end attachment cylinder angle $\theta$ is the same value $\theta 1$. In the illustrations of FIGS. 5A and 5B, the end attachment cylinder angle $\theta$ is determined as the angle between a line segment L1 and a line segment L2. The line segment L1 is a line segment connecting the foot pin 9*a* of the end attachment cylinder 9 and a connecting pin 6*b*. The line segment L2 is a line segment connecting the foot pin 9*a* and a rod pin 9*b* of the end attachment cylinder 9. The connecting pin 6*b* is a pin to which one end of a first end attachment link 6*c* is pivotably connected. The other end of the first end attachment link 6*c* is pivotably connected to the rod pin 9*b* of the end attachment cylinder 9. One end of a second end attachment link 6*d* is pivotably connected to the rod pin 9*b* of the end attachment cylinder 9. The other end of the second end attachment link 6*d* is pivotably connected to a second end attachment foot pin 6*e* of the lift-mag 6.

According to this configuration, it may be impossible for the end attachment angle sensor S3 to determine the end attachment angle $\alpha$ based solely on the end attachment cylinder angle 9. This is because even when the end attachment cylinder angle $\theta$ is the same single value $\theta 1$, the end attachment angle $\alpha$ can take two values (the value $\alpha 1$ and the value $\alpha 2$). This is based on the fact that as the end attachment angle $\alpha$ monotonously increases, the end attachment cylinder angle $\theta$ increases and thereafter decreases.

Therefore, the controller 30 determines the end attachment angle $\alpha$ by additionally obtaining the direction of operation of the lift-mag 6. For example, the controller 30 detects a pilot pressure generated by the lift-mag operation lever serving as the operating apparatus 26, and determines whether the lift-mag operation lever is operated in a closing direction or in an opening direction.

In response to determining that the lift-mag 6 is operated in the opening direction and that the end attachment cylinder angle $\theta$ is on the increase, the controller 30 determines the value $\alpha 2$ of the end attachment angle $\alpha$ from the value $\theta 1$ of the end attachment cylinder angle $\theta$. In response to determining that the lift-mag 6 is operated in the closing direction and that the end attachment cylinder angle $\theta$ is on the decrease, the controller 30 determines the value $\alpha 2$ of the end attachment angle $\alpha$ from the value $\theta 1$ of the end attachment cylinder angle $\theta$.

In response to determining that the lift-mag 6 is operated in the opening direction and that the end attachment cylinder angle $\theta$ is on the decrease, the controller 30 determines the value $\alpha 1$ of the end attachment angle $\alpha$ from the value $\theta 1$ of the end attachment cylinder angle $\theta$. In response to determining that the lift-mag 6 is operated in the closing direction and that the end attachment cylinder angle $\theta$ is on the increase, the controller 30 determines the value $\alpha 1$ of the end attachment angle $\alpha$ from the value $\theta 1$ of the end attachment cylinder angle $\theta$.

According to the above-described configuration, the controller 30 can appropriately determine the end attachment angle $\alpha$ from the end attachment cylinder angle $\theta$ even when two end attachment angles $\alpha$ can correspond to a single end attachment cylinder angle $\theta$.

An embodiment of the present invention is described in detail above, but the present invention is not limited to the specific embodiment as described above. Variations and replacements may be applied to embodiments of the present invention without departing from the scope of the present invention recited in the claims.

For example, while the above-described interference preventing function is applied to a work machine including the cab elevator 12, the present invention is not limited to this configuration. For example, the above-described interference preventing function may be applied to a work machine including an offset mechanism or a swing mechanism. In this case, the motion of reducing a distance between the end attachment and the cab 10 includes the motion of the swing mechanism and the motion of the offset mechanism.

What is claimed is:

1. A work machine comprising:

a traveling undercarriage;

an upper rotating structure swingably mounted on the traveling undercarriage;

a cab mounted on the upper rotating structure;

a cab elevator configured to move up and down the cab;

an attachment including a plurality of work elements, the attachment being attached to the upper rotating structure;

an end attachment attached to an end of the attachment;

a first sensor configured to obtain angles of rotation of the work elements;

a second sensor configured to obtain an angle of rotation of the end attachment; and a control device configured to restrict or stop a motion of reducing a distance between the end attachment and the cab in response to determining that the end attachment has entered a predetermined region based on outputs of the first sensor and the second sensor, wherein the control device is configured to set the predetermined region according to a position of the cab, and vertically move up the predetermined region as the cab is vertically moved up by the cab elevator and vertically move down the predetermined region as the cab is vertically moved down by the cab elevator.

2. The work machine as claimed in claim 1, further comprising:

an end attachment cylinder configured to drive the end attachment, wherein the second sensor is placed on a foot pin of the end attachment cylinder.

3. The work machine as claimed in claim 1, further comprising:

an end attachment operation lever for operating the end attachment, wherein the control device is configured to determine the angle of rotation of the end attachment based on the output of the second sensor and a content of an operation of the end attachment operation lever.

4. The work machine as claimed in claim 1, wherein the motion of reducing the distance between the end attachment and the cab includes a motion of the cab and a motion of a swing mechanism.

5. The work machine as claimed in claim 1, wherein the work elements includes an arm, and a distance between an end attachment foot pin and the cab of the work machine at a time of restricting or stopping the motion of reducing the distance between the end attachment and the cab changes according to the angle of rotation of the end attachment, the end attachment foot pin being provided at an end of the arm.

6. The work machine as claimed in claim 1, wherein a range of movement of the end attachment is restricted based on a position of a cab-side end of the end attachment.

7. The work machine as claimed in claim 1, wherein the control device is configured to move the predetermined region such that a distance from the cab to a boundary of the predetermined region remains constant as a height of the cab changes.

8. The work machine as claimed in claim 1, wherein the control device is configured to set the predetermined region according to a center point of the cab.

9. The work machine as claimed in claim 1, wherein the predetermined region is defined by a vertically extending boundary.

* * * * *